US006923727B1

(12) United States Patent
Jacobs

(10) Patent No.: US 6,923,727 B1
(45) Date of Patent: Aug. 2, 2005

(54) SWING TRAINING AID

(76) Inventor: Scott Aaron Jacobs, 2705 Lake Way, Cooper City, FL (US) 33026

( * ) Notice: Subject to any disclaimer, the term of this patent is extended or adjusted under 35 U.S.C. 154(b) by 0 days.

(21) Appl. No.: 10/857,525

(22) Filed: May 29, 2004

(51) Int. Cl.[7] ..... A63B 69/36
(52) U.S. Cl. ..... 473/206; 473/226; 473/300
(58) Field of Search ..... 473/201, 203, 473/204, 206, 212, 226, 300, 302, 303, 538; 273/DIG. 30; 280/821; D21/758, 791

(56) References Cited

U.S. PATENT DOCUMENTS 1,692,201 A * 11/1928 Denman et al. ..... 473/205
1,734,684 A * 11/1929 Lyndon ..... 473/206
3,111,322 A 11/1963 English
3,323,367 A 6/1967 Searle
3,408,075 A * 10/1968 Colton ..... 473/204
3,687,458 A 8/1972 Proctor
3,762,720 A 10/1973 Jett
3,806,130 A 4/1974 Jacques
3,931,968 A 1/1976 Hedberg
3,995,856 A 12/1976 Hollendorfer, Jr.
4,065,127 A 12/1977 Fagan
4,098,506 A 7/1978 Gaiser
4,103,896 A 8/1978 Lorang
4,138,118 A 2/1979 Budney
4,252,319 A 2/1981 Lorang
4,269,412 A 5/1981 Hughes
4,361,326 A 11/1982 Kokes
4,655,449 A 4/1987 Chamness
4,664,381 A 5/1987 Aaron
4,861,034 A 8/1989 Lee
4,930,785 A 6/1990 Mills
4,981,297 A 1/1991 Foster
5,011,145 A 4/1991 Bartkowicz
5,018,734 A * 5/1991 Allsop ..... 473/551
5,035,428 A 7/1991 Bartkowicz
5,163,685 A 11/1992 Rhodes
5,221,088 A 6/1993 McTeigue et al.
5,238,246 A 8/1993 Erb
5,295,688 A 3/1994 Montgomery
5,299,802 A 4/1994 Bouchet-Lassale
5,322,281 A 6/1994 Ganger, Sr.
5,322,289 A 6/1994 Abrams et al.
5,342,046 A 8/1994 Erb
5,355,552 A 10/1994 Huang
5,377,541 A 1/1995 Patten
5,419,563 A 5/1995 Abrams et al.
5,431,395 A 7/1995 Ganger, Sr.

(Continued)

FOREIGN PATENT DOCUMENTS

FR 2626483 4/1989

(Continued)

*Primary Examiner*—Gregory Vidovich
*Assistant Examiner*—Nini F. Legesse

(57) ABSTRACT

The present invention is directed to a training aid which may be used with a playing device such as a golf club or baseball bat. Embodiments of the present invention may be temporarily attached to a playing device and modify how a person holds, or grips, the playing device. The present invention comprises a first portion that may be temporarily attached to part of the playing device that is gripped by a person. When the present invention is temporarily attached to a playing device and a person grips the present invention, a second portion extends at least part of one finger of the person a distance from the playing device.

8 Claims, 6 Drawing Sheets

U.S. PATENT DOCUMENTS 5,439,217 A 8/1995 Ganger, Sr.
5,542,676 A 8/1996 Howe, Jr. et al.
5,692,265 A 12/1997 Dalury
5,704,845 A * 1/1998 Boyte ..... 473/205
5,762,563 A 6/1998 Holzhausen
5,851,156 A 12/1998 Schwark, Jr.
5,984,795 A 11/1999 Stafford
6,036,607 A 3/2000 Finegan
6,152,831 A * 11/2000 Arcenas ..... 473/206
6,299,557 B1 10/2001 Mueller
6,540,621 B1 4/2003 Robinson
6,648,770 B1 11/2003 Snyder
6,652,941 B1 11/2003 Chadwick et al.
6,705,951 B2 3/2004 Beauregard
6,716,034 B2 4/2004 Casanova et al.
D500,352 S * 12/2004 Sullivan ..... D21/791

FOREIGN PATENT DOCUMENTS

GB 2386326 A 11/2002
JP 2001-087439 4/2001
NL 9402147 1/1996

* cited by examiner

SWING TRAINING AID

BACKGROUND OF THE INVENTION

Fundamental in obtaining proficiency in many sports such as golf and baseball requires that a playing device be held, or gripped, properly. Applying a proper grip involves not only correct hand orientation on the playing device but also involves the proper application of grip pressure. Problems using a playing device may arise from excessive grip pressure by either hand or both hands. Currently, there are disclosures which are directed to modifying or measuring hand position and grip pressure. There are patents directed to training aids which use electrical systems. Such patents include U.S. Pat. Nos. 3,323,367; 3,762,720; 4,103,896; 4,138,118; 4,861,034; 4,930,785; 5,221,088; 5,322,281; 5,322,289; 5,377,541; 5,419,563; 5,431,395; 5,439,217; 5,542,676; 6,716,034; French Patent Number 2,626,483; and Netherlands Patent Number 9,402,147. There are patents directed to a person's finger orientation and/or grip pressure. Such patents include U.S. Pat. Nos. 3,111,322; 3,687,458; 3,931,968; 4,269,412; 4,655,449; 4,664,381; 5,355,552; 5,692,265; 6,648,770; 6,652,941 and Japan Patent Number 2001-087439. There are also patents directed to devices to be used with existing grips. Such patents include U.S. Pat. Nos. 3,806,130; 3,995,856; 4,065,127; 4,098,506; 4,252,319; 4,361,326; 4,981,297; 5,011,145; 5,035,428; 5,163,685; 5,238,246; 5,295,688; 5,299,802; 5,342,046; 5,762,563; 5,851,156; 5,984,795; 6,036,607; 6,299,557; 6,540,621; 6,705,951; and U.K. Patent Application 2,386,326.

Citation of a reference herein shall not be construed as an admission that such reference is prior art to the present invention.

SUMMARY OF THE INVENTION

The present invention is directed to a training aid for use with a playing device which is gripped by a person. According to one aspect of the present invention, the training aid is dimensioned to be temporarily attached to part of the playing device that would be gripped by a person. According to another aspect of the present invention, the training aid, when attached to a playing device and gripped by a person, extends at least part of one finger of a person gripping a training aid a distance from the playing device.

The present invention is further directed to a training aid which may be used with a golf club.

The present invention is further directed to a training aid which may be used with a baseball bat.

The present invention is also directed to a method of using the training aid described herein.

The present invention is also directed to a method of manufacturing the training aid described herein.

The present invention is also directed to a kit which comprises the training aid.

These and other features and advantages of the present invention will be readily apparent from the following detailed description of the invention, the scope of the invention being set out in the appended claims.

DETAILED DESCRIPTION OF THE INVENTION

Figure 1A:
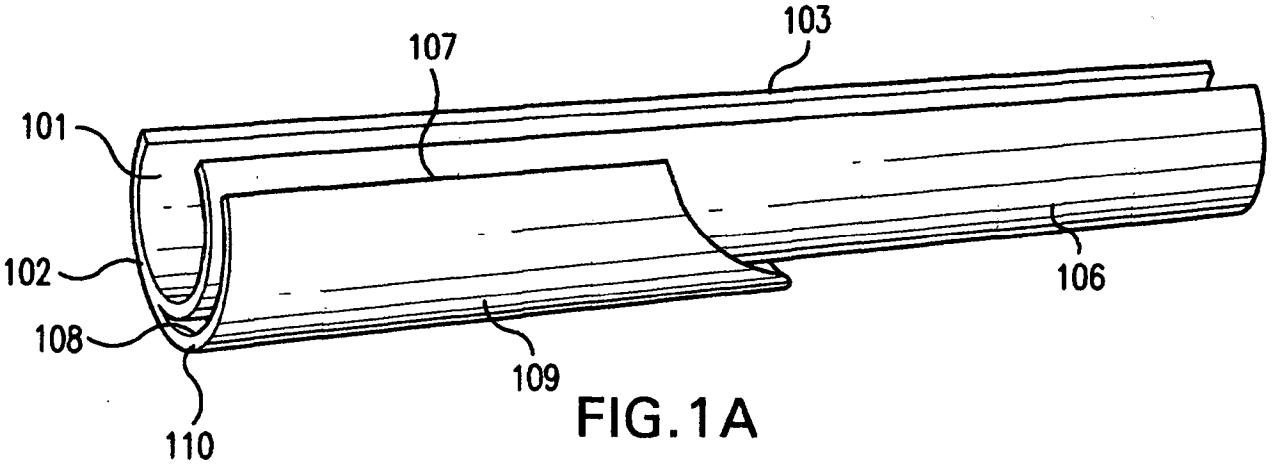
FIG. 1 shows various views of an embodiment of the present invention.
Figure 1B:
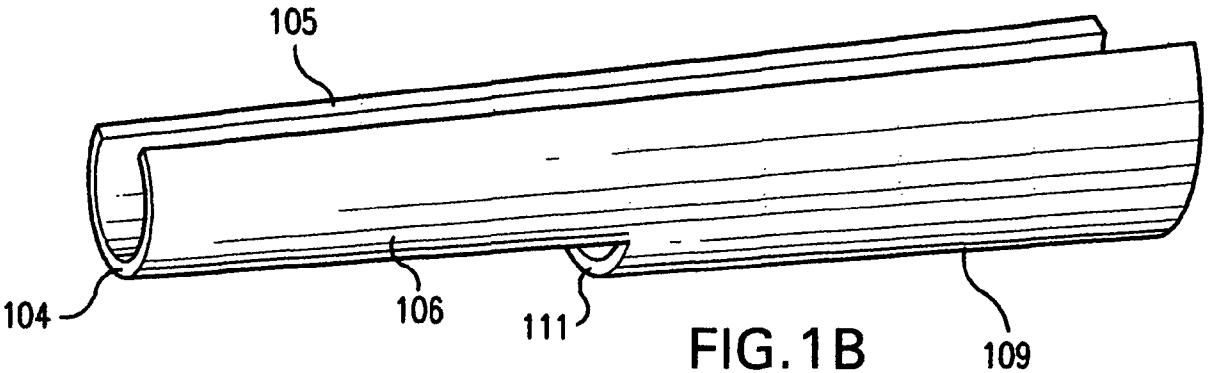
Figure 1C:
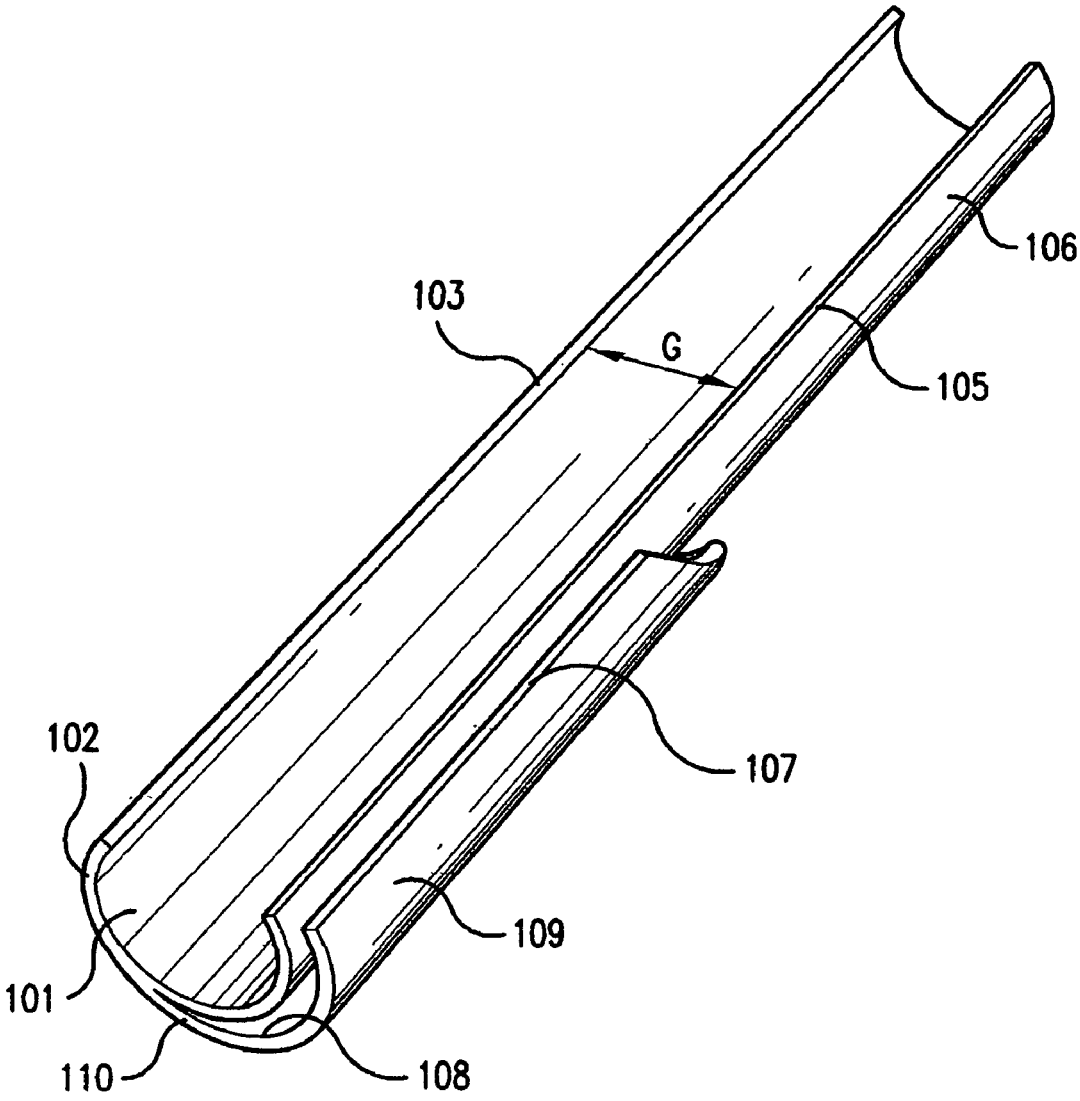
Figure 1D:
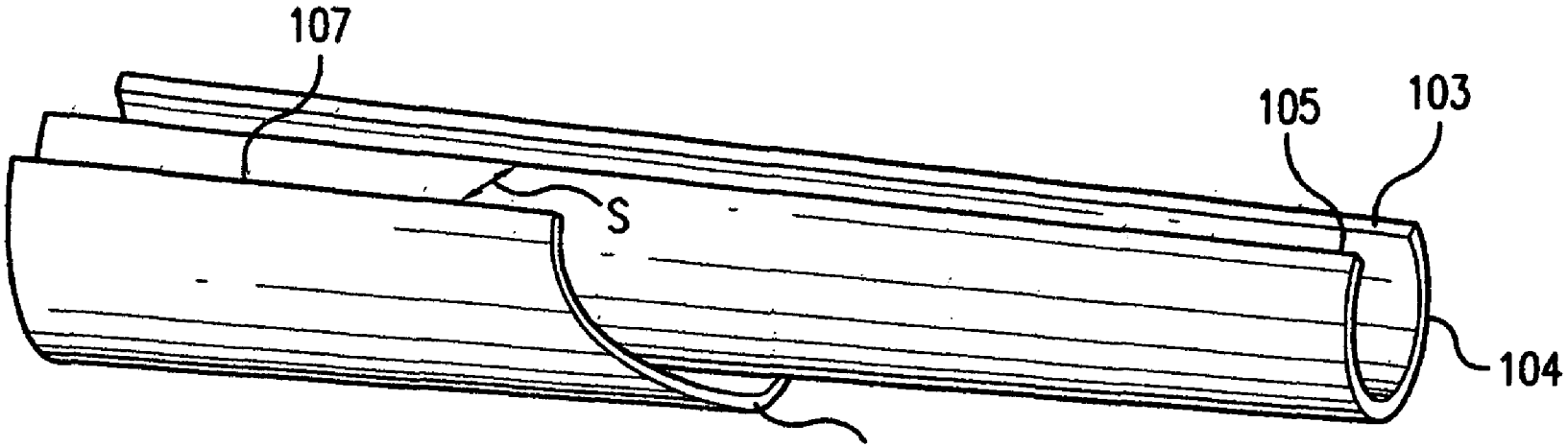

FIG. 1 shows an embodiment of the present invention which comprises a first portion and a second portion. The first portion has a first interior surface (101), a first butt end (102), a first end (103), a first head end (104), a second end (105), and a first exterior surface (106). The first portion has a first thickness, the distance between the first interior surface and the first exterior surface, which may vary at different locations of the first portion. A gap (G) is between the first and second ends along the length of the first portion. The gap is not limited to being equal distance between the first and second ends along the length of the first portion. The first interior surface is the part of the present invention which comes in contact with and is dimensioned to be temporarily attached to part of a playing device that would be gripped by a person. The first interior surface is tapered in that the first interior surface, from the first end to the second end, narrows along its length from the first butt end to the first head end.

The first portion of the present invention may be temporarily attached to a playing device. As used herein, "temporarily attached" means the first interior surface is dimensioned to be repeatedly attached to and dislodged from a length of a playing device by a percentage of the circumference of the playing device. As used herein, "a length of a playing device by a percentage of the circumference of the playing device" is synonymous with "corresponding part of a grip" and any derivations thereof. The percentage of the circumference of the playing device which the first interior surface is dimensioned to be temporarily attached to depends on the shape of the playing device which the training aid is to be used with. Preferably, the percentage of the circumference of the playing device is greater than 50%. More preferably, the percentage is greater than 66%. Most preferably, the percentage is greater than 80%. Embodiments of the present invention may be temporarily attached to any part of a playing device that would be gripped by a person. The present invention may be repeatedly attached to and dislodged from a corresponding part of a grip without any fastening means other than the friction fitting of the first interior surface to the corresponding part of the grip.

The first interior surface of the present invention may be dimensioned to be temporarily attached to a variety of shaped grips. One such shaped grip is a tapered grip. An example of a playing device which has a tapered grip is a golf club which comprises a head, which strikes a golf ball; a shaft, which is connected to the head; and a grip, which overlaps of the shaft and is gripped by a person. A tapered golf club grip, the diameter of which decreases from the end of the grip furthest from the head of the club, or the butt end, to the end of the grip closest to the head, or the head end, may vary from having a butt end diameter of about 0.85 inches and a head end diameter of about 0.47 inches to having a butt end diameter of about 1.20 inches and a head end diameter of about 0.68 inches. As used herein, the term "about" is defined as being within 5% of said value. Embodiments of the present invention may be dimensioned to be temporarily attached to the spectrum of different sized tapered golf grips. Preferably, embodiments of the present invention may be dimensioned to be temporarily attached to any part of a tapered golf club grip. Preferably, embodiments of the present invention may be dimensioned to be temporarily attached to a tapered golf club grip where the first butt end is within 10 inches of the butt end of the golf club grip. More preferably, embodiments of the present invention may be dimensioned to be temporarily attached to a tapered golf club grip where the first butt end is within 5 inches of the butt end of the golf club grip. Most preferably, embodiments of the present invention may be dimensioned to be temporarily attached to a tapered golf club grip near, where the first butt end is within 3 inches of, the butt end of the golf club grip. The first interior surface may be dimensioned for other shaped grips including, but not limited to, cylindrically shaped grip including that of a baseball bat, and non-tapered grips including, for example, golf clubs that have combination grips, grips that have a combination of curved and flat surfaces (e.g., some golf putters).

When the training aid is temporarily attached to a corresponding part of a grip and gripped by a person, the second portion extends at least part of one finger of the a person's hand a distance from the playing device. As seen in FIG. 1, the second portion of the present invention is connected to the first portion. The length of the second portion ends at the second portion end (107). The second portion also has a second interior surface (108), a second exterior surface (109); a second butt end (110), and a second head end (111). The second portion has a second thickness, the distance between the second interior surface and the second exterior surface, which may vary at different locations of the second portion. There is a space (S) between the first exterior surface and the second interior surface.

An embodiment of the present invention may be one piece. For such an embodiment, as in FIG. 1, the second interior surface, second exterior surface, second butt end, and second head end begin along the second thickness where the space between the first and second portions begins. An embodiment of the present invention may also be more than one piece. For example, the first and second portions are separate pieces. For such an embodiment, the second exterior surface, second interior surface, second butt end, and second head end may begin at a second connection surface, which connects to a first connection surface on the first exterior surface (embodiment not shown).

When the present invention is attached to a playing device and a person grips the training aid, the second exterior surface extends at least part of one finger a distance from the playing device. As used herein, "distance from the playing device" is defined as the separation between playing device and the second exterior surface. Preferably, the separation is greater than the largest first thickness. More preferably, the separation is large enough that a space between the first exterior surface and second interior surface exists. Most preferably, the separation is greater than the combined thickness of the largest first thickness and the largest second thickness.

The at least part of one finger of a person's hand that is extended a distance from a playing device may vary. The at least part of one finger of a person's hand that is extended from a playing device may be from the tip of one finger to the knuckle closest to the tip of the same finger. The at least part of one finger of a person's hand that is extended a distance from a playing device may be from the tip of one finger to the second knuckle closest to the tip of the same finger. The at least part of one finger of a person's hand that is extended a distance from a playing device may be the entire finger. The at least part of one finger of a person's hand that is extended a distance from a playing device may be from where the finger is connected to the palm of the hand to the second knuckle closest to the tip of the same finger. The at least part of one finger of a person's hand that is extended a distance from a playing device may be from where the finger is connected to the palm of the hand to the first knuckle closest to the tip of the same finger.

The at least part of one finger of a person's hand that is extended a distance from the playing device may be parts of a number of fingers. The fingers which may be affected are the fingers furthest from the thumb that is also called the last finger; the next to last finger from the thumb that is also called the third finger; the second finger closest to the thumb that is also called the second finger; the finger closest to the thumb that is also called the first finger; and the thumb. Preferably, at least part of one finger may be extended a distance from the playing device when the training aid is attached to corresponding part of the grip and gripped by the person. More preferably, at least part of two fingers may be extended a distance from playing device when the training aid is attached to the corresponding part of the grip and gripped by the person. Most preferably, at least part of three or more fingers may be extended a distance from the playing device when the training aid is attached to the corresponding part of the grip and gripped by the person.

The shape of the second portion and where the second portion is connected to the first portion may vary. The location where the second portion connects to the first portion is not limited to that shown in FIG. 1. The location where the second portion connects to the first portion may be at different positions of the first portion. When the present invention is attached to a playing device and a person grips the present invention, only the at least part of one finger of a person's hand to be extended a distance from the playing device contacts the second exterior surface. This may require that the width of the second portion narrows from where the second portion connects to the first portion to the second portion end. The second portion may be shaped so that the at least part of one finger of a person's hand to be extended a distance from the playing device may have a similar contour to that of the first interior surface. As used herein, "similar contour" and any derivations thereof means that the appearance is of the same kind without being identical. As seen in FIG. 1, for example, the second exterior surface has a similar contour as the contour of the first interior surface wherein the second exterior surface curves around the playing device as the first interior surface does but not identically as seen in the second exterior surface curving further away from the playing device than the first interior surface. Another embodiment of the present invention may have the second portion connected to a staggered length of the first exterior surface so as to extend different parts of different fingers. For example, an embodiment of the present invention may extend the entire last finger from the thumb of a person's hand and only the tip of the third finger from the thumb of a person's hand. For such an embodiment, part of the second portion may be connected to the first exterior surface closer to the first end to extend the last finger and the other part staggered closer to the second end to extend the tip of the third finger (embodiment not shown). Another embodiment of the present invention may have two separate second portions connected to the first exterior surface to extend two different fingers of the same hand (embodiment not shown). Separate second portions may also extend at least part of one finger of each hand a distance from the playing (embodiment not shown).

Figure 2A:
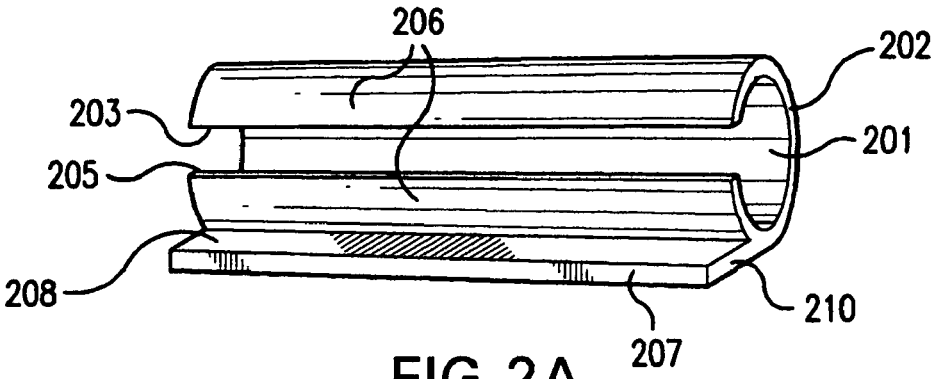
FIG. 2 shows various views of another embodiment of the present invention.
Figure 2B:
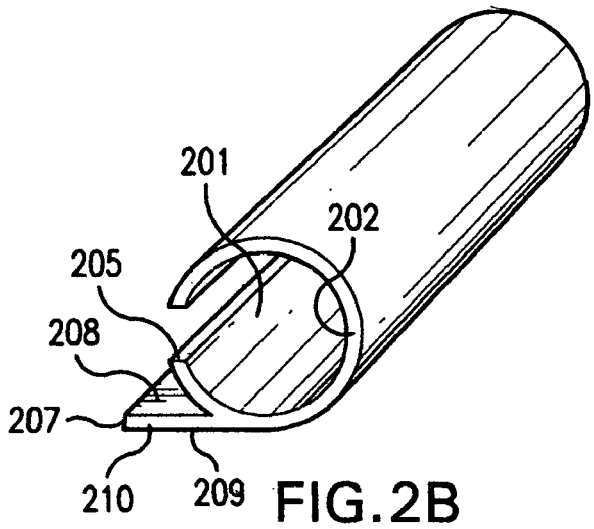
Figure 2C:
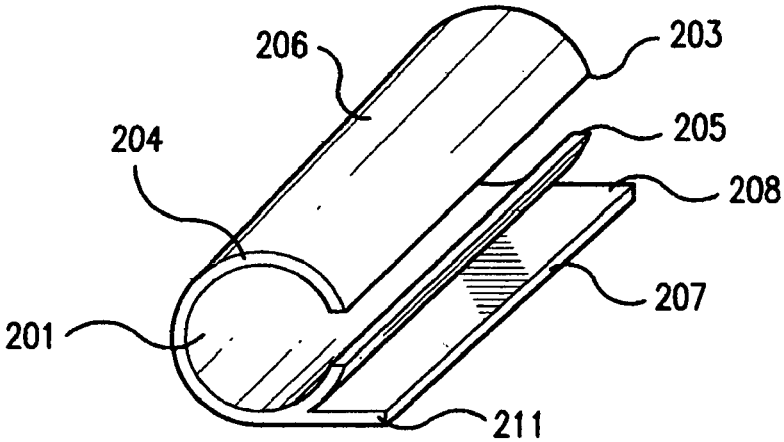

FIG. 2 shows another embodiment of the present invention. The first portion has a first interior surface (201), a first butt end (202), a first end (203), a first head end (204), a second end (205), and a first exterior surface (206). A gap along the length of the first portion is defined by, or exists between, the first and second ends. The first interior surface is the part of the present invention which comes in contact with and is dimensioned to be temporarily attached to the part of a playing device that would be gripped by a person. The first interior surface is tapered in that the first interior surface narrows along its length from the first butt end to the first head end. The second portion of the present invention has a second portion end (207), a second interior surface (208), a second exterior surface (209), a second butt end (210), and a second head end (211). The second portion is connected to the first exterior surface at a location closer to the second end than the first end. Unlike the embodiment shown in FIG. 1, the length of the first portion, from the first butt end to the first head end, is as long as the width of the second portion.

Attachment of the training aid to the playing device may be accomplished by a variety of methods. One method in which the present invention may be attached to the corresponding part of a grip is by passing a part of the playing device through the gap between the first and second ends and then sliding the training aid along the playing device until the first interior surface attaches to the corresponding part of the grip. Another method in which the present invention may be attached to the corresponding part of a grip is by flexing the first portion wherein the gap between the first and second ends increases enough to pass the corresponding part of the grip between the first and second ends thereby placing the corresponding part of the grip in contact with the first interior surface. The force used to flex the first portion can then be removed allowing the training aid to be attached to the corresponding part of the grip. Another method may incorporate the two methods just described where an embodiment of the present invention may be flexed to pass a part of the playing device through the gap between the first and second ends, the force used to flex the first portion may then be removed, and the embodiment then may be slid along the playing device until the first interior surface attaches to the corresponding part of the grip.

Dislodging the present invention from a playing device may be accomplished by a variety of methods. One method for dislodging an attached training aid from the corresponding part of a grip may be accomplished by pushing the training aid toward an adjacent part of the playing device that has a smaller diameter than the corresponding part of the grip and then passing the playing device through the gap between the first and second ends. Another method in which an embodiment of the present invention may be dislodged from the corresponding part of a grip may be accomplished by flexing the first portion to increase the gap between first and second ends and the playing device then may be passed through the increased gap between the first and the second ends. The first end and second end may then be returned to their previous position with regards to each other. Another method in which an embodiment of the present invention may be dislodged from a playing device may be accomplished with a combination of the above described methods. The training aid may be pushed toward an adjacent part of the playing device that has a smaller diameter than the corresponding part of the grip, the first and second edges may then be flexed to increase the gap between the first and second edges, and the playing device may be passed through the increased gap between the first and second edges. The first end and second end may then be returned to their previous position with regards to each other.

Figure 3A:
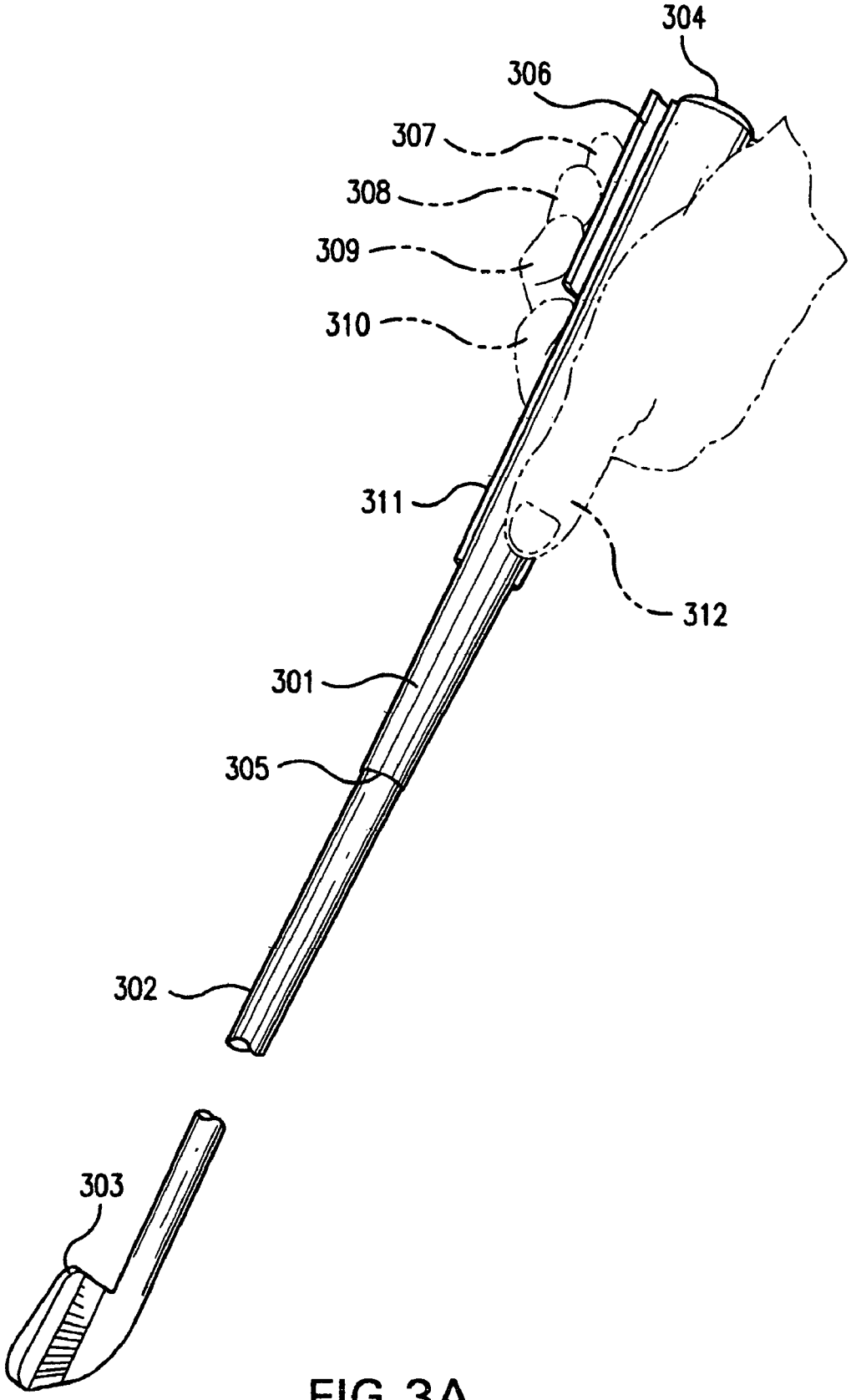
FIG. 3 shows the embodiment of FIGS. 1 and 2 affixed to a golf club and gripped by a hand.
Figure 3B:
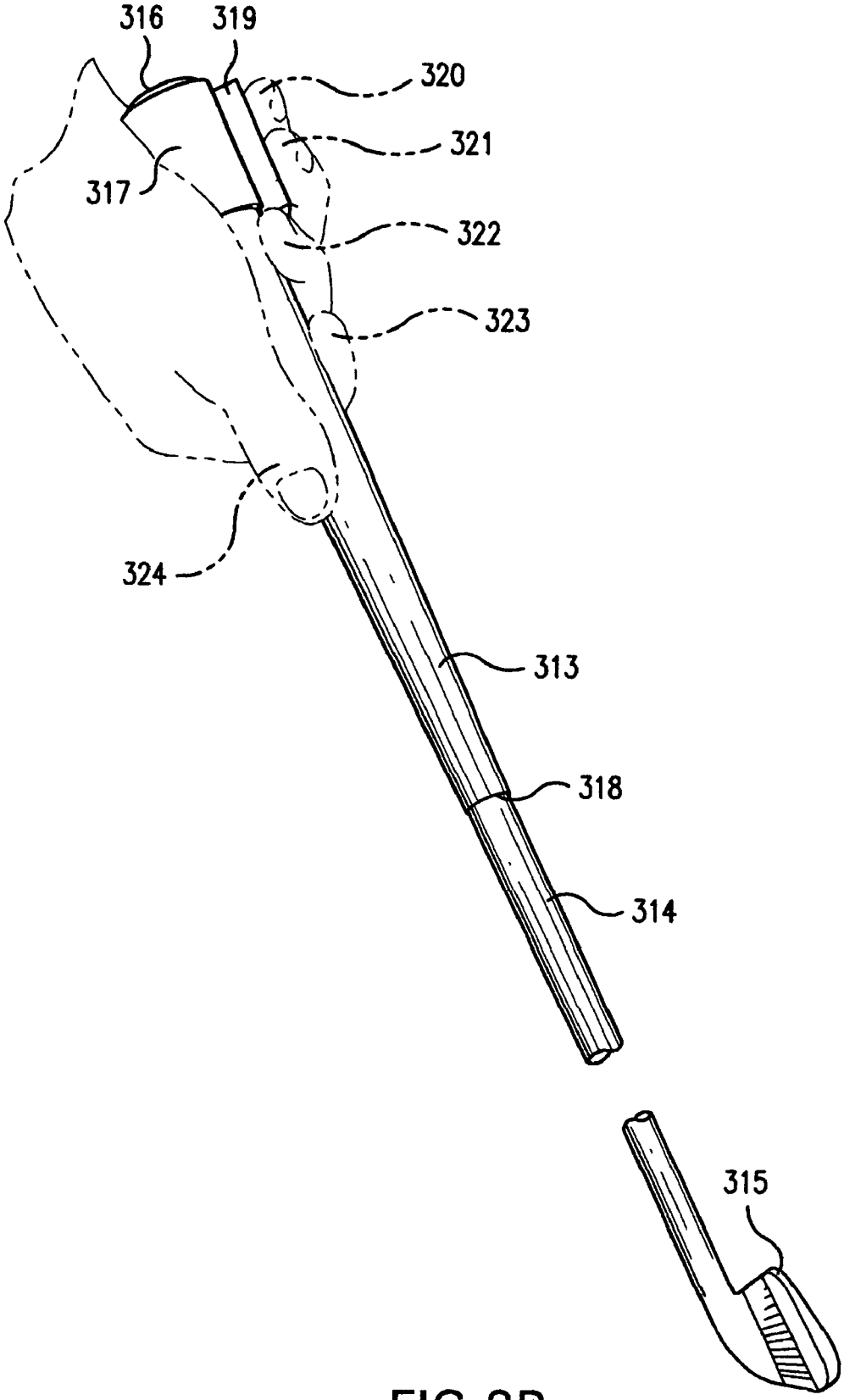

FIG. 3 shows the embodiments of FIGS. 1 and 2 attached to golf clubs. In FIG. 3A, the embodiment of FIG. 1 is attached to a golf club, which has a grip (301), a shaft (302) and, a head (303). The embodiment is attached to the golf club grip near the butt end (304) of the golf club grip. The second portion (306) is in contact with and extends only the last three fingers (307, 308, and 309) of a left hand a distance from the playing device. The first finger (310) is in contact with and wraps around the first exterior surface (311) and the thumb (312) is in contact with the grip. In FIG. 3B, the embodiment of FIG. 2 is attached to a golf club, which has a grip (313), a shaft (314) and, a head (315). The embodiment is attached to the golf club grip near the butt end (316) of the golf club grip. The second portion (319) is in contact with and extends only the last two fingers (320 and 321) of a right hand a distance from the playing device. The second finger (322) and first finger (323) are in contact with and wrap around the grip. The thumb (224) is in contact with the grip. The second finger, first finger, and thumb do not contact the first exterior surface (317).

Fingers which are not extended a distance from the playing device by the second exterior surface may be in contact with the playing device or the first exterior surface. As seen in FIG. 3A, the first finger (310) of the left hand is in contact with and wraps around the first exterior surface (311) and the thumb (312) is in contact with the playing device. The part of the training aid between the first finger and the first head end of the training aid may be gripped by the person's other hand (not shown). As shown in FIG. 3B, the second finger (322), first finger (323), and thumb (324) of the right hand are in contact with the playing device because the length of the first exterior surface is the same as the second portion's width where the first and second portions connect. The other hand, which grips further down the golf club, (not shown) would be in contact with the golf club grip.

Embodiments of the present invention may be used to modify the pressure exerted on a playing device. When an embodiment of the present invention is attached to a corresponding part of a grip and gripped by a person so that at least part of one finger is extended a distance from the playing device, it is more difficult for the person to exert the same grip pressure as when the embodiment is not attached and the person grips only the playing device. This results in the person having a lighter grip on the training aid, decreases the tension in the arm of the hand which has the at least part of one finger extended a distance from the playing device and allows the playing device to be swung more freely thereby increasing swing speed and force. Grip pressure can be varied depending on which at least part of a finger is extended a distance from the playing device. The person can practice with the embodiment attached to the playing device and learn to exert one or more grip pressures. The embodiment can be dislodged from the corresponding part of the grip and the person can exert the one or more grip pressures on the playing device.

Embodiments of the present invention may be manufactured from a number of materials which may include, but are not limited to, sheet metal, plastic, fiberglass, polymers, and composite materials. Embodiments of the present invention may be manufactured from sheet metal. This may entail cutting and bending a piece of sheet metal. Preferably, the sheet metal is as thick as or thicker than 28 gauge galvanized steel. More preferably, the sheet metal is as thick as or thicker than 26 gauge galvanized steel. Embodiments of the present invention manufactured from sheet metal may also be coated with plastic or other appropriate material. Such a coating may improve the feel of the embodiment, protect the person using the embodiment from possibly being injured, and improve the esthetics of the embodiment. Embodiments of the present invention may also be manufactured by injection molding. The manufacturing of embodiments of the present invention by injection molding my include the material to be used, which may include thermoplastic compounds such as acrylonitrile butadiene styrene (ABS); geometry parameters in part design and mold design that may include thickness of the present invention, the number of gates, gate location, gate thickness and area, and the type of gate; and manufacturing parameters, which may include fill time, packing pressure, mold temperature and melt temperature.

Entire embodiments of the training aid may be manufactured to be rigid. This would require that the first interior surface be dimensioned to fit a specifically sized corresponding part of a grip. Rigid embodiments must also be dimensioned so that a playing device may pass through the gap between the first and second ends when attaching and dislodging the embodiment. A rigid embodiment would also have a rigid second portion.

Embodiments of the training aid may be flexible and resilient. Flexible and resilient embodiments may have a first portion that may be flexed to fit a variety of sizes of the corresponding part of a grip. Flexible and resilient embodiments may also have a second portion which may flex when gripped by at least part of one finger.

Embodiments of the present invention may have a combination of rigid and flexible and resilient portions. One example of such a combination includes an embodiment of a training aid that comprises more than one part. Such an embodiment may have a flexible and resilient first portion which may be mechanically connected to a rigid second portion. Another example may have a rigid first portion which may be mechanically connected to a flexible and resilient second portion. Such mechanical connections may occur with interlocking tabs and groves.

The present invention is also directed to a kit which includes the training aid. The kit may comprise the training aid and any combination of the following: instructions for the use of the training aid in written, audio tape, video tape, or digital video disc format; a box; and a bag.

EXAMPLE

The present invention is exemplified by the following. It should be understood that the present invention is not limited to the example and changes and modifications may be made to the present invention without departing from the spirit and scope thereof.

An example of the present invention is manufactured from 26 gauge galvanized sheet metal. The first portion is about 6.3 inches in length, about 1.0 inch wide at the first butt end, and about 0.9 inch wide at the first head end. The height of the first portion is about 0.9 inch at the first butt end and about 0.8 inch at the first head end. The gap at the first butt end is about 0.9 inch and gradually decreases to about 0.6 inch at the first head end. The second portion is connected to the first portion at a bend in the sheet metal at the first end. The first and second butt ends are connected at the bend in the sheet metal. The second portion narrows from about 3.5 inches at the first end to about 2.8 inches at the second portion end with the second head end gradually curving closer toward the second butt end. The space between the first exterior surface and second interior surface begins at the bend in the sheet metal and increases to about 0.3 inch at the second portion end.

All patents, patent applications and other references cited in the foregoing text are herein incorporated by reference in their entirety. The scope of the following claims is intended to encompass all obvious changes in the details, materials, and arrangement of parts that will occur to one of ordinary skill in the art of designing and manufacturing devices such as the present invention.

What is claimed is:

1. A one piece training aid for use with a golf club, which has a tapered grip, consisting of:

(a) a first portion having a first interior surface, a first exterior surface, a first butt end, a first head end, a first end, a second end, and a first thickness wherein the first interior surface is dimensioned to be temporarily attached to a corresponding part of the tapered grip near a butt end of the golf club;

(b) a second portion having a second interior surface, a second exterior surface, a second butt end, a second head end, a second portion end, a second portion second end, and a second thickness wherein the second portion second end is connected to the first portion, and the second exterior surface is contoured similarly to the first interior surface;

wherein when the first interior surface is attached to the corresponding part of the tapered grip and a person's hand grips the one piece training aid, the second portion end and the first exterior surface are spaced apart so that the second exterior surface extends the three fingers furthest from the thumb of the person's hand a distance form the tapered grip.

2. The one piece training aid of claim 1 wherein the training aid is manufactured from sheet metal.

3. The one piece training aid of claim 2 wherein the sheet metal is galvanized steel.

4. The one piece training aid of claim 3 wherein the galvanized steel sheet metal is 26 gauge.

5. The one piece training aid of claim 1 wherein the training aid is manufactured from plastic.

6. The one piece training aid of claim 5 wherein the plastic is acrylonitrile butadiene styrene.

7. The training aid of claim 1 wherein the training aid is for use by a right-handed golfer.

8. The training aid of claim 1 wherein the training aid is for use by a left-handed golfer.

* * * * *